United States Patent [19]

Byrd et al.

[11] 4,278,523

[45] Jul. 14, 1981

[54] CLAMPING DIAPHRAGMS OR MEMBRANES IN ELECTROLYTIC CELLS

[75] Inventors: Geoffrey C. Byrd, Frodsham; Colin Stanier, Northwich, both of England

[73] Assignee: Imperial Chemical Industries Limited, London, England

[21] Appl. No.: 59,448

[22] Filed: Jul. 20, 1979

[30] Foreign Application Priority Data

Jul. 28, 1978 [GB] United Kingdom ..... 31585/78
Nov. 10, 1978 [GB] United Kingdom ..... 43954/78

[51] Int. Cl.[3] ..... C25B 9/00; C25B 13/02; C25B 11/03

[52] U.S. Cl. ..... 204/252; 204/279; 204/283; 204/295; 204/296

[58] Field of Search ..... 204/252–258, 204/263–266, 283, 279, 295–296

[56] References Cited

U.S. PATENT DOCUMENTS

| | | | |
|---|---|---|---|
| 1,420,037 | 6/1922 | Harris | 204/258 |
| 1,464,689 | 8/1923 | Allan | 204/254 |
| 1,856,218 | 5/1932 | Knowles | 204/266 |
| 3,878,082 | 4/1975 | Gokhale | 204/252 X |
| 3,923,630 | 12/1975 | Argade et al. | 204/283 X |
| 3,980,544 | 9/1976 | Adams et al. | 204/253 X |
| 4,146,457 | 3/1979 | Couper et al. | 204/252 |
| 4,153,530 | 5/1979 | Vallance et al. | 204/266 X |
| 4,175,024 | 11/1979 | Darlington | 204/289 X |
| 4,191,627 | 3/1980 | Specht | 204/283 X |
| 4,196,071 | 4/1980 | Wood et al. | 204/266 |

FOREIGN PATENT DOCUMENTS

| | | |
|---|---|---|
| 268998 | 4/1927 | United Kingdom . |
| 901305 | 7/1962 | United Kingdom . |

*Primary Examiner*—D. R. Valentine
*Attorney, Agent, or Firm*—Cushman, Darby & Cushman

[57] ABSTRACT

An electrolytic diaphragm or membrane cell is disclosed in which flexible clamp members are arranged to provide sealing engagement between the diaphragm or membrane and its associated support elements.

16 Claims, 14 Drawing Figures

CLAMPING DIAPHRAGMS OR MEMBRANES IN ELECTROLYTIC CELLS

This invention relates to electrolytic cells of the diaphragm or membrane type.

Porous diaphragms based on tetrafluoroethylene polymers are especially suitable for use in cells electrolysing alkali metal chloride solutions. Unfortunately, however, there are problems associated with the development of the use of such diaphragms in electrolytic cells. For example, there is generally a limit on the dimensions of the diaphragm sheets that can be produced in practice. Of necessity the width of the diaphragm sheet is governed by the size of the rolls employed in producing the sheet. The cost of increasing the size of the manufacturing equipment is exponential with the result that there is an optimum size of roll, and thus of the resultant sheet, which is dependent upon purely commercial factors. Moreover, diaphragms of simple rectangular sheet form, and also ion permselective membranes of this form, are difficult to fit on to the complicated cathode designs of modern electrolytic cells because of the numerous recesses and protruberances presented by the cathode. The aforesaid problems apply particularly to diaphragms and membranes made of non-melt-processable materials, for example diaphragms or membranes based on fluoropolymers. The main reason for this is that is is extremely difficult to join together small sheets of such materials in order to produce a diaphragm or membrane of the desired complex shape and size.

In the specification of our British Patent Application No. 28804/74 (Belgian Pat. No. 830739) we have described a method of manufacturing a porous diaphragm for use in an electrolytic cell from a plurality of sheets of filled polytetrafluoroethylene which method comprises fusing a melt-processable fluorine-containing polymer into the sheets at or near juxtaposed edges of the sheets at a temperature which will not substantially decompose the filler in the sheets, solidifying the melt-processable polymer so as to effect joining of the sheets, and thereafter removing filler from the thus joined sheets to produce a porous sheet.

By the term "filled polytetrafluoroethylene sheet" we mean polytetrafluoroethylene sheet containing a removable solid particulate additive, e.g. starch, which may be removed from the sheet in order to impart porosity to the sheet. The resultant porous sheet may then be used as a diaphragm in an electrolytic cell.

By melt-processable fluorine-containing polymer we mean a fluorine-containing polymer which may be fused by the application of heat and which returns to its original form on removal of heat and also retains its original properties.

In the specification of our copending British Patent Application No. 15279/77 there is described an electrolytic diaphragm cell for the production of halogen, hydrogen and an alkali metal hydroxide solution by electrolysis of an aqueous alkali metal halide solution which cell comprises a plurality of anodes vertically mounted on the base of the cell, a cathode box providing a cathode between adjacent anodes, and a hydraulically permeable diaphragm between adjacent anodes and cathodes, wherein the diaphragms comprise one or more sheets of a porous non-melt-processable fluorine-containing polymer joined into the form of an endless-belt by a strip or strips of melt-processable fluorine-containing polymer fused into the sheet or sheets at or near juxtaposed edges of the sheet or sheets, the diaphragms being connected to upper and lower slotted supports of a melt-processable fluorine-containing polymer by means of strips of a melt-processable fluorine-containing polymer bonded to the supports at or near the slots therein and fused to the upper and lower edges of the diaphragm, and wherein the supports are located in the cell so that the slots in the upper and lower supports are in vertical alignment with one another and the anodes extend through the slots of the lower support and into the spaces defined by the endless-belt diaphragms.

In the specification of our copending British Patent Application No. 15280/77 there is described an electrolytic diaphragm cell for the production of halogen, hydrogen and an alkali metal halide solution, which cell comprises a plurality of anodes vertically mounted at one side of the cell, a cathode box mounted at the opposite facing side of the cell and providing a cathode between adjacent anodes, a hydraulically permeable diaphragm between adjacent anodes and cathodes, wherein the diaphragm comprises a sheet of a porous non-melt-processable fluorine-containing polymer connected to upper and lower slotted supports of a melt-processable fluorine-containing polymer fused to the upper and lower edges of the diaphragm, and wherein the supports are located in the cell so that the slots in the upper and lower supports are in vertical alignment with one another and the anodes extend into the space defined by the upper and lower supports and the diaphragms.

The diaphragm described in the specification of UK Application No. 15280/77 may be in the form of a single sheet of the non-melt processable fluorine-containing polymer, but in commercial cells, the diaphragm conveniently comprises a plurality of sheets of the non-melt processable fluorine-containing polymer which are joined together by a strip or strips of melt-processable fluorine-containing polymer fused into the sheets at or near juxtaposed edges of the sheets. The joining of adjacent sheets by means of the aforesaid strip or strips may be carried out using conventional plastics fabrication techniques, such as hot-pressing.

The joining of the upper and lower slotted supports to strips of melt-processable fluorine-containing polymer fused into the diaphragm at or near the upper and lower edges respectively of the diaphragm may be carried out by conventional plastics fabrication techniques such as hot pressing or by the application of a suitable cement (e.g. a low melting point fluorine-containing polymer). The joint thus produced between the diaphragm and the supports, although generally satisfactory, does have a disadvantage of relatively low strength, and the aforesaid joint can be further weakened or even broken during handling, e.g. whilst assembling the diaphragm and associated supports into a cell, thereby giving rise to imperfections in the sealing between the diaphragms and the supports. Such imperfections, if present, may lead to leakage of liquor between the anode and cathode compartments of the cells.

A further disadvantage of the aforesaid joints is that wrinkles can occur along the joint during its fabrication and this in turn can adversely affect the performance of the diaphragm.

We have now found a method of supporting a diaphragm in a cell in which the above mentioned disadvantages are obviated or mitigated. The method of support may also be used to install an ion permselective membrane in an electrolytic cell.

According to the present invention there is provided an electrolytic cell which comprises a plurality of anodes, a cathode box providing a plurality of cathodes so positioned that an anode is located between each pair of adjacent cathodes, a diaphragm or membrane located between adjacent anodes and cathodes, and slotted diaphragm- or membrane-supports made of material which is resistant to the conditions prevailing in the cell, the supports being located such that the slots in one support are in alignment with the slots in the other support and the edges of the diaphragms or membranes being sealed to lips defining the slots in the supports whereby the arrangement of diaphragms or membranes and the slots in the supports define spaces into which the anodes extend, and wherein each diaphragm or membrane is sealed to the lips defining a slot in the support by means of one or more clamps which form an essentially leak-tight seal between the diaphragm or membrane and the lips of the support.

In a preferred diaphragm cell according to the invention, the diaphragm or membrane is an endless belt located between a pair of adjacent cathodes and defining a channel into which extends an anode so that the endless belt provides a diaphragm between the anode and each adjacent cathode. In this embodiment the ends of the diaphragms are attached to the lips on the support defining the slots therein to provide an essentially leak-tight seal and provide anode and cathode compartments between which the passage of liquid is essentially only through the diaphragm.

The endless belt diaphragm may be made, as also may an endless-belt membrane, by joining the edges of a sheet by the method described in our British Patent Application No. 28804/74 (Belgian Pat. No. 830,739), referred to hereinbefore, or by the method described in our British Patent Application No. 54141/77. In the latter Patent Application there is described a method of joining together a sheet or sheets of a polymer which is not normally melt-processable, which method comprises contacting a strip of melt-processable organic polymer with the faces of the sheet or sheets in the region of juxtaposed edges, stitching the strip to the sheet or sheets by means of a thread, and heating the strip in order to fuse the strip and/or the thread to seal the holes created by stitching, and, where the strip has not previously been fused to the faces of the sheet or sheets, in order to fuse the strip to the faces of the sheet or sheets.

The preferred embodiment of the electrolytic cell of the invention is a cell in which the anodes are disposed substantially vertically and the diaphragm- or membrane-supports are disposed substantially horizontally, that is there is an upper support above the cathode box and a lower support below the cathode box, the slots in the upper support being vertically aligned with the slots in the lower support and together with the diaphragms or membranes forming spaces or channels between adjacent cathodes in which the anodes are located such that there is a diaphragm or membrane between each pair of adjacent anodes and cathodes.

In the preferred embodiment of electrolytic cell wherein the anodes are disposed vertically, the cell may be of the type generally described in the aforementioned British Patent Application No. 15279/77 and may comprise a plurality of anodes vertically mounted on the base of the cell, a cathode box providing a plurality of cathodes so positioned that a cathode is located between adjacent anodes, and a diaphragm or membrane in the form of an endless belt positioned around each anode and attached to the lips of the supports defining the slots in the supports by means of one or more clamps which form an essentially leak-tight seal between the diaphragm or membrane and the support.

Alternatively the preferred embodiment may be a cell of the type generally described in the aforementioned British Patent Application No. 15280/77 and may comprise a plurality of vertically disposed anodes mounted on one side of the cell, a cathode box mounted on the opposite facing side of the cell and providing a plurality of cathodes so positioned that a cathode is located between adjacent anodes, and a diaphragm or membrane positioned between adjacent anodes and cathodes and attached to the lips of the support defining the slots in the supports by means of one or more clamps which form an essentially leak-tight seal between the diaphragm or membrane and the supports.

In the electrolytic cell of the invention, a diaphragm or membrane is interposed between each pair of adjacent electrodes, that is a diaphragm or membrane is provided between each anode and the cathodes adjacent to it. In addition to the diaphragm or membrane there may be provided one or more separating screens which are inert under the conditions prevailing in the cell. Thus if desired an inert separating screen may be interposed between the diaphragm or membrane and one or both of the electrodes between which the diaphragm or membrane is interposed. If provided, the separating screen or screens may be attached to the diaphragm- or membrane-supports by the same clamp or clamps which attach the diaphragm or membrane to the supports, that is the edges of the supporting screen(s) may be clamped between the edges of the diaphragm or membrane and the lips of the supports defining the slots in the supports so that the clamp holds the three members together.

The porous hydraulically-permeable diaphragm or the ion permselective membrane, is usually made of an organic polymeric material. Suitable diaphragms may be made, for example, from a non-melt-processable, fluorine-containing polymer, e.g. polytetrafluoroethylene. Suitable membranes include cation permselective membranes made of fluorine-containing polymers containing pendant sulphonyl groups or sulphonyl groups which have been treated with ammonia or with an amine, for example membranes sold under the trade name "Nafion" by E I duPont de Nemours Incorporated.

In the case of a diaphragm, its structure and the method of achieving porosity are not critical. For example, the porous diaphragm may be made from a sheet of organic polymer containing a removable filler, and the filler may be removed in order to create a porous sheet.

A filled sheet may be prepared from an aqueous dispersion of, for example, polytetrafluoroethylene and a filler by the methods described in our British Patent Specifications Nos. 1,081,046 and 1,424,804. The filler may be removed prior to introducing the sheet into the cell, for example by treatment with acid to dissolve the filler in the case where the filler is starch or calcium carbonate. Alternatively the filler may be removed from the sheet in situ in the cell, for example as described in our British Patent Specification No. 1,468,355 in which the filler may be removed from the sheet by using a solvent, e.g. an acid, or in which the filler may be removed electrolytically.

Alternatively, the diaphragm may be a porous sheet of polymeric material containing units derived from tetrafluoroethylene, the sheet having a microstructure characterised by nodes interconnected by fibrils. Such a sheet and its preparation are described in British Patent Specification No. 1,355,373, and its use as a diaphragm in electromechanical cells is described in our British Patent Specification No. 1,503,915.

The diaphragm may also be formed by an electrostatic spinning process. Such a process is described in our British Patent Specification No. 1,522,605 and comprises introducing a spinning liquid comprising an organic fibre-forming polymeric material, for example a fluoropolymer, e.g. polytetrafluoroethylene, into an electric field whereby fibres are drawn from the liquid to an electrode and collecting the fibres so produced upon the electrode in the form of a porous sheet or mat.

The porous diaphragm may contain a non-removable filler, e.g. titanium dioxide, in order to render the diaphragm wettable by aqueous solutions when the diaphragm is used in an electrolytic cell.

Ion permselective membranes may suitably be cation permselective membranes in the case where the electrolytic cell is to be used in the production of halogen and alkali metal hydroxide by the electrolysis of aqueous alkali metal halide solution. As stated hereinbefore, the membrane may be a fluorine-containing polymer containing pendant sulphonyl groups or sulphonyl groups which have been treated with ammonia or with an amine. Such membranes are well known in the art.

The diaphragm- or membrane-supports are made of a material which is resistant to the conditions prevailing in the cell, usually an organic polymeric material. The supports are resistant to degradation by the electrolyte present in the electrolytic cell, and resistant to degradation by the products of electrolysis, and thus where the cell is used in the production of halogen and alkali metal hydroxide by the electrolysis of alkali metal halide solution it is preferred to use supports made of a fluorine-containing polymer. For ease of fabrication supports of a melt-processable fluorine-containing polymer are preferred.

Suitable melt-processable fluorine-containing polymers include polychlorotrifluoroethylene, fluorinated ethylene/propylene copolymer, or a copolymer of ethylene and chlorotrifluoroethylene. It is especially preferred to use a fluorinated ethylene/propylene copolymer as the melt-processable fluorine-containing polymer. The supports may be made of a non-melt-processable fluorine-containing polymer, e.g. polyvinylidene fluoride or polytetrafluoroethylene. The supports may if desired be made of the same material as the diaphragm or membrane.

The slotted supports may be formed by punching out one or more slots from a sheet of the organic polymeric material. It is convenient for ease of assembly in a cell to form an upstanding lip defining the slots by folding the material of the support at the edge of each slot. Alternatively, the slotted supports may be moulded from a suitable melt-processable organic polymeric material by moulding a sheet having upstanding sections at the positions where slots are required, and subsequently removing parts of the upstanding sections so as to leave a lip around the edges of and defining the slots.

It is preferred for reasons of ease of assembly of and for optimum sealing efficiency in, the electrolytic cell that the lips on the slotted supports project outwardly. Thus, where the anodes are positioned vertically in the cell and the cell comprises upper and lower horizontal slotted supports, the lips of the upper support preferably project upwardly and the lips of the lower support preferably project downwardly.

The clamp or clamps used to attach the diaphragm or membrane to the supports may have a variety of forms but will usually comprise an inner clamp member in the form of a flexible strip of material, conveniently a band, of a size such that it will fit within a slot in the support with just sufficient clearance from the lips defining the slot to accommodate the diaphragm or membrane. In the preferred case where the diaphragm or membrane is an endless belt, the inner clamp member is a band which preferably is a sliding fit inside the belt.

In assembling the support/diaphragm or/membrane structure in a cell, an outer clamp member is located around the lips defining the slot in the support and the diaphragm(s) or membrane(s) is/are located internally of the lips of the support. The clamp is then completed by an inner clamp member which traps the diaphragm(s) or membrane(s) and the upstanding lips defining the slot between the inner and outer clamp members.

The outer clamp member may be, for example, a wire or rod which is located around the lip on the support and tightened by twisting after insertion of the inner clamp member to urge the lip inwards towards the inner clamp member and press together the lip and the edges of the diaphragm(s) or membrane(s) between the outer and inner clamp members. If desired, spring clips of essentially U-section may be located to complete the clamp; these are fitted such that the assembly of inner band, diaphragm(s) or membrane(s) and outer wire or rod are located within the arms of the clips. Instead of spring clips there may be used non-resilient clips which are fitted over the assembly and then crimped to hold the assembly in position.

An alternative form of outer clamp member is a strip, conveniently a band, of a size such that it fits around the lip on the support; this strip or band is applied around the lip and after insertion of the inner clamp member, the clamp members are urged together to entrap the lips of the support and the diaphragm(s) or membrane(s). One form of such a clamp comprises inner and outer bands which may be urged together and/or held in position by means of spring clips of essentially U-section which fit over the assembly of strips or bands, lip and diaphragm(s) or membrane(s) as described hereinbefore. Instead of spring clips there may be employed clips of U-section which are crimped over the assembly.

In the aforementioned clamps, the inner and outer clamp members are described as being urged together and/or held in position by means of individual spring clips or crimped clips. It will readily be appreciated that instead of a number of individual clips there may be employed a single clipping device which has the effect of a number of individual clips. Thus, for example, a resilient wire may be bent into a sinuous form, for example to yield square or rectangular profiles, and assembled over the inner and outer clamp elements such that alternate profiles or groups or profiles lie on opposite sides of the clamp elements. A clipping device of this type is shown in FIGS. 9 and 10 of the accompanying drawings.

As an alternative to a clamp comprising inner and outer bands and spring clips or clips which are crimped over the assembly as described, there may be used a clamp wherein the inner and outer bands and the clips are formed as an integral unit. For example the clamp may comprise a channel-shaped member of essentially U-section or hemi-cylindrical section, that is a 'U'-shape in which the arms of the 'U' point inwardly. If desired portions of the material forming the base of the U-shaped or hemi-cylindrical channel are cut out so that the clamp has the appearance of inner and outer bands bridged at predetermined intervals by integral bridging sections. In using a channel-type clamp, as in the case of separate bands and external clips, the assembly of lip on the support and diaphragm(s) and membrane(s) is located between the inner and outer bands of the clamp and the bridging sections of the clamp are crimped; alternatively the clamp may be sufficiently resilient to grip the assembly without being crimped.

In any of the clamp configurations described hereinbefore, a strip or paste of an elastomeric material which is resistant to the conditions prevailing in the cell is preferably inserted between the diaphragm(s) or membrane(s) and the lips on the support during application of the clamp(s). The elastomeric material serves to reduce the possibility of damage to the support and/or the diaphragm(s) or membrane(s) during application of the clamp(s) and to assist in the formation of a leak-tight seal between the support and the diaphragm(s) or membrane(s). It is also preferred to apply a similar insert between the faces of the clamp elements and the lips and diaphragm(s) or membrane(s). It is especially preferred to roll the edges of the diaphragm over the lip on the support and trap the rolled-over edges inside the outer clamp member. Alternatively the edges of the lips on the support may be rolled over the edges of the diaphragm or membrane and trapped by the inner clamp member.

The clamp members may be made of any material which is resistant to the conditions prevailing in the cell, for example a polymeric material or a metal such as steel coated with a polymeric material, but are preferably made of one of the film-forming metals titanium, zirconium, niobium, tantalum and tungsten, or a film-forming metal alloy, that is an alloy based on one or more of the said film-forming metals and having anodic polarisation properties similar to those of the commercially pure film-forming metal. If a film-forming metal is used for the clamp members, it may if desired be protected against cell conditions by coating with one or more of the platinum group metals, i.e. platinum, rhodium, iridium, ruthenium, osmium and palladium. The preferred materials for the clamp members are titanium and platinised titanium.

The anodes of the cell are typically of a film-forming metal, e.g. titanium, and are provided with an electrocatalytically active coating, for example of a mixture of a platinum group metal oxide and a film-forming metal oxide, especially a mixture of ruthenium oxide and titanium dioxide.

The cathodes are preferably comprised of mild steel or iron mesh, and are mounted in the cathode box which is typically of mild steel. The cathode box is provided with openings through which the anodes pass. The cathode box is provided with a current-outlet lead, an outlet for alkali metal hydroxide solution and an outlet for hydrogen.

The cell is suitably provided with a lid, for example of mild steel coated internally with ebonite, carrying an inlet for aqueous alkali metal halide solution and an outlet for gaseous halogen.

The invention will now be described by way of example only with reference to the accompanying drawings in which.

Figure 5:
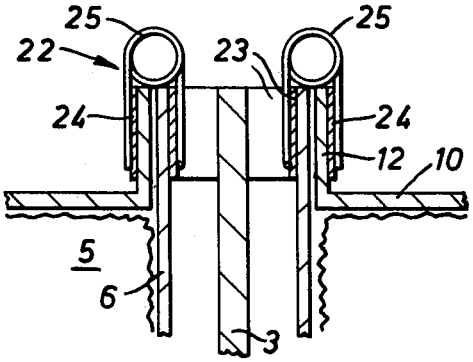
FIG. 5 shows an enlarged cross-sectional view in side elevation of the part of the cell of FIG. 1 between the lines C—C and showing the clamp in position.
Figure 6:
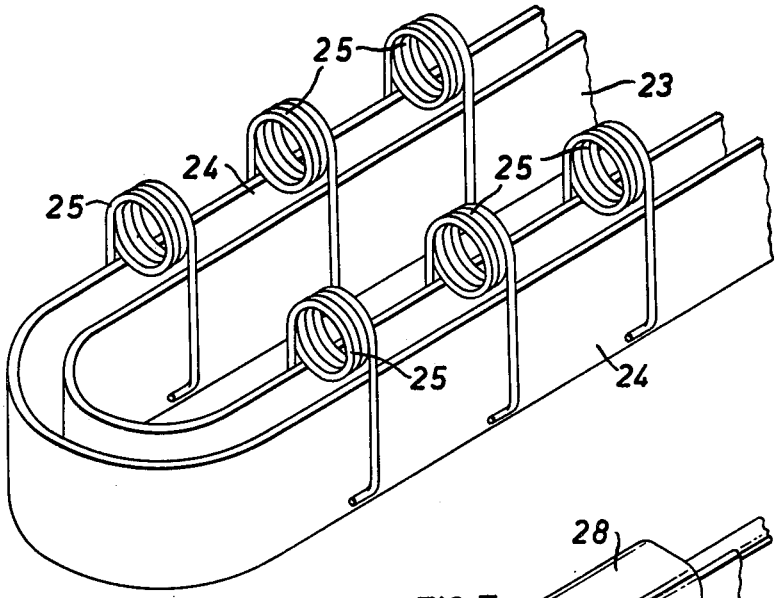
FIG. 6 shows a perspective view of the clamp of FIG. 5.
Figure 7:
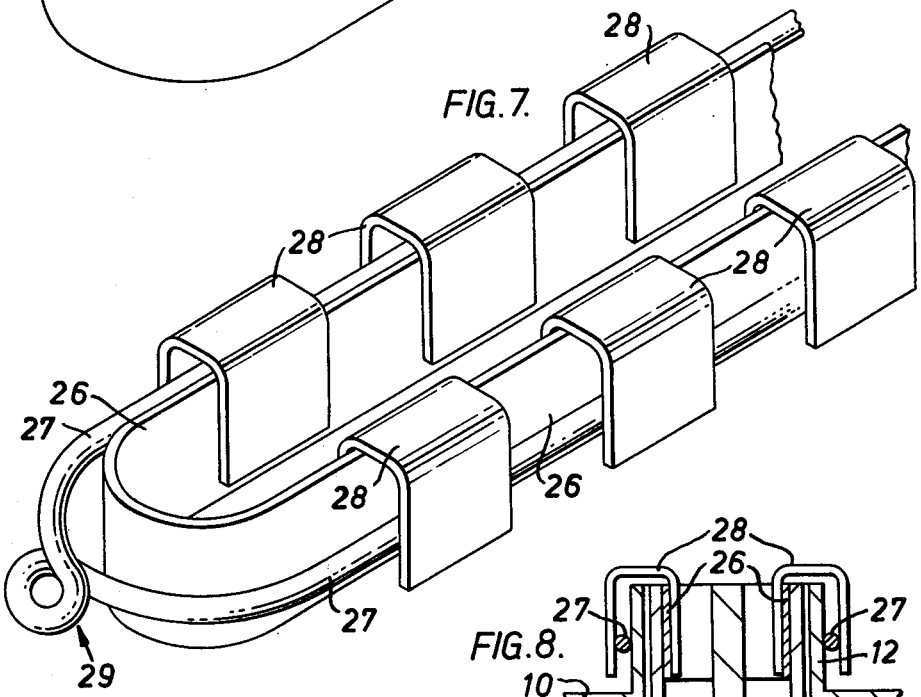
Figure 8:
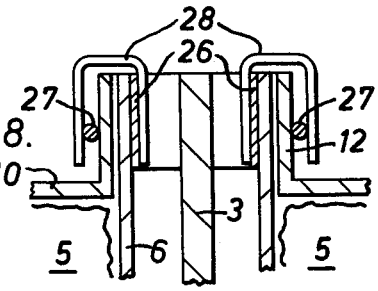

FIGS. 7 and 8 show respectively a perspective view and a sectional view of an alternative form of the clamp to that shown in FIG. 5 and FIG. 6, FIGS. 9 and 10 show respectively a perspective view and a sectional view of a further alternative form of clamp to that shown in FIGS. 5 and 6, FIGS. 11 and 12 show respectively a perspective view and a sectional view of a still further alternative form of clamp to that shown in FIGS. 5 and 6, and FIGS. 13 and 14 show respectively a sectional view and a plan view of a further alternative form of clamp.

Figure 1:
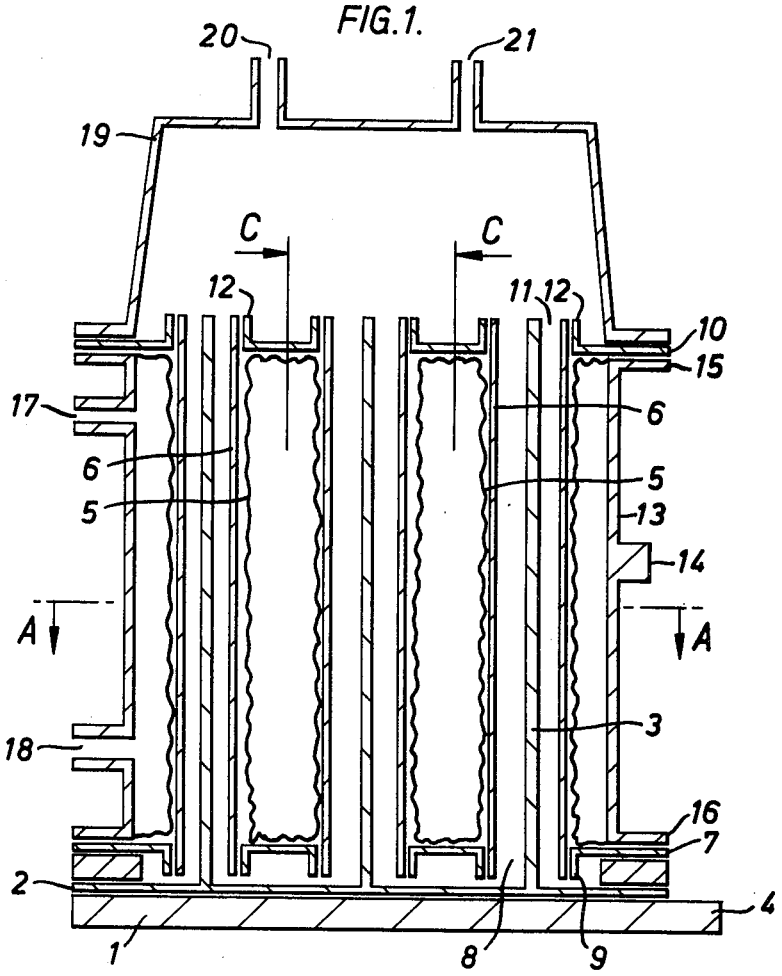
FIG. 1 shows a cross-sectional view in side elevation of an electrolytic cell according to the invention but wherein the clamps are omitted for the sake of clarity, the section being taken along the line B—B in FIGS. 2, 3 or 4.
Figure 2:
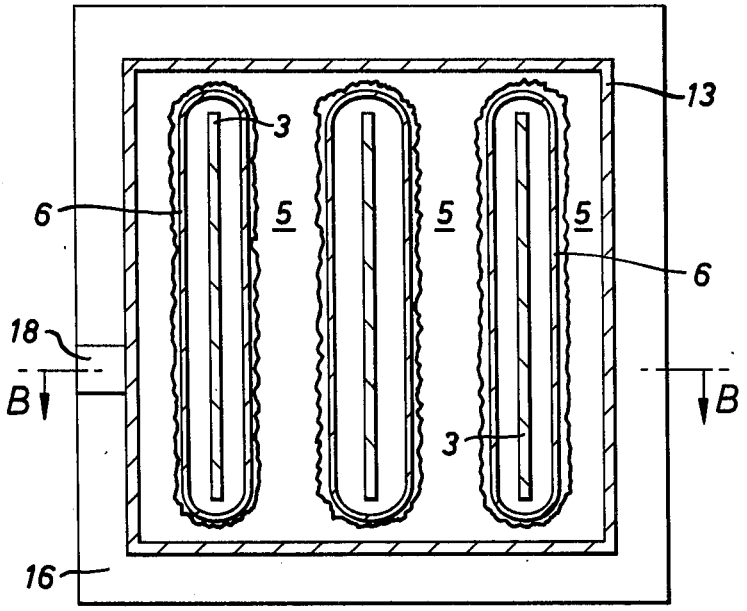
FIGS. 2, 3 and 4 show cross-sectional plan views of three alternative configurations of the cell shown in FIG. 1, taken along the line A—A of FIG. 1.

Referring to FIGS. 1 and 2, the electrolytic cell comprises a mild steel base (1) clad with a titanium sheet (2) and vertically disposed anodes (3) of titanium in electrical and mechanical contact with the sheet (2). The mild steel base (1) is provided with a projecting part (4) which serves as a positive terminal. The cell also comprises a cathode box (5) made of mild steel and located such that the anodes are positioned between adjacent cathodes. A hydraulically permeable porous diaphragm (6) is positioned around each anode (3) and between each anode (3) and adjacent cathode (5). The diaphragm (6) may if desired be replaced by an ion permselective membrane. Beneath the cathode box (5) there is positioned a sheet or diaphragm-support (7), having slots (8) and downwardly projecting lips (9) at the edges of the slots. Above the cathode box (5) there is positioned a sheet or diaphragm-support (10) having slots (11) and upwardly projecting lips (12) at the edges of the slots. The sheets (7) and (10) are made of a fluorinated ethylene/propylene copolymer. The side walls of the cell are provided by a casing (13) which carries a negative terminal (14), flanges (15, 16), an inlet (17) for removing hydrogen from the cell and an outlet (18) for removing alkali metal hydroxide solution from the cell. The cell has a flanged cover (19) which is provided with an inlet (20) through which aqueous alkali metal halide solution may be charged to the cell and an outlet (21) through which chlorine may be removed from the cell.

The flanges of the cover (19) are bolted to the upper flanges of the casing (13) and the lower flanges of the casing (13) are bolted to the titanium clad mild steel base (1). The bolts are not shown. The sheets (10) and (7) also project between the flanges and are thereby held in position.

The means by which the diaphragm, or membrane, (6) is sealed to the lips of the upper and lower slotted supports (10) and (7) is described with reference to FIG. 5. For convenience, the means is described in relation to the cell configuration shown in FIG. 2 in which the diaphragm (6) is an endless belt and the support sheets (10) and (7) are slotted.

The diaphragm (6) is positioned in the slot (11) of the sheet (10) with the upper part of the diaphragm adjacent to and in contact with the lip (12) of the sheet (10). A clamp (22) comprising an inner band (23) and an outer band (24) held together by spring clips (25) is positioned over and in contact with the upper part of the diaphragm (6) and the lip (12), the clips 25 serving to urge the bands together to form a lead-tight seal between the diaphragm and the lip of the sheet.

If desired a strip of an elastomeric material may be inserted between the diaphragm (6) and the lip (12) of the support (10) to provide a degree of resilience which serves to reduce the possibility of damage to the lip and/or to the diaphragm when the clamp is applied over the assembly. If desired an adhesive may be applied between the lip (12) and inner face of outer band (24) and/or between the diaphragm and outer face of inner band (23).

The means by which the diaphragm (6) is sealed to the lips (12) of the upper slotted sheet (10) are also used to seal the diaphragm to the lips (9) of the lower slotted sheet (7).

Figure 3:
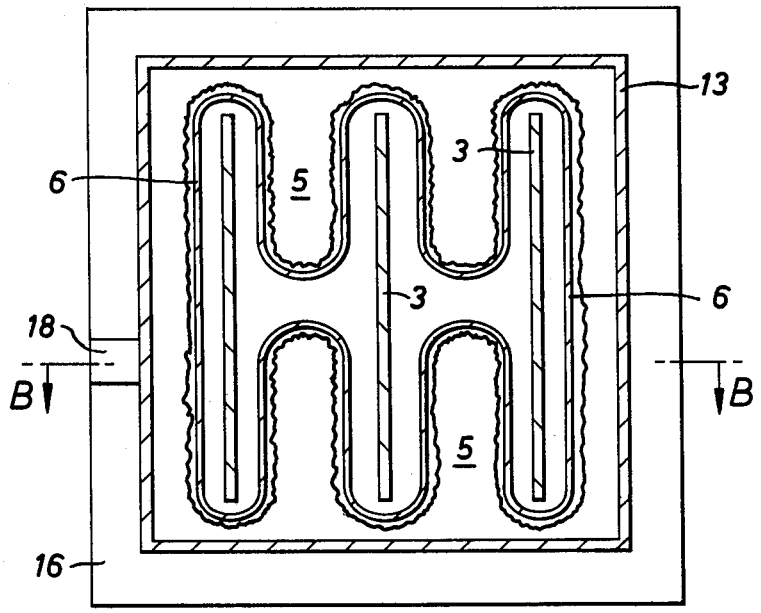
Figure 4:
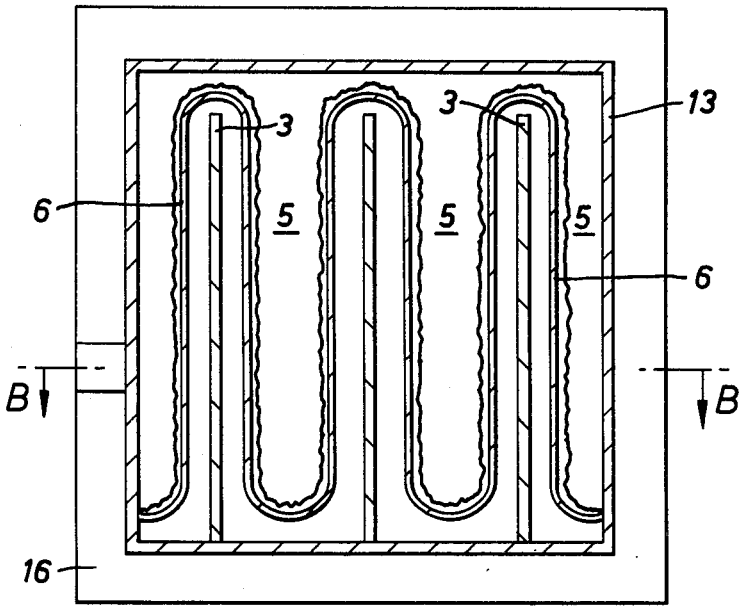

It will be readily apparent from the above description how using a similar clamp the diaphragm or membrane is clamped to the support sheets (7) and (10) in the cells shown in FIGS. 3 and 4.

A portion of the clamp of FIG. 5 is shown in perspective in FIG. 6, wherein the reference numerals are the same as are used in FIG. 5.

An alternative form of clamp is shown in FIGS. 7 and 8 wherein for simplicity only the diaphragm (6) and support sheet (10) being clamped are shown in FIG. 8. The clamp comprises an inner band (26), an outer rod (27) and U-section clips (28). The assembled edges of diaphragm (6) and support sheet (10) are located between the inner band (26) and the rod (27) as shown in FIG. 5 and the rod is tightened by twisting as shown at 29 in FIG. 7. The clips (28) are applied over the assembly and are crimped into position.

Figure 9:
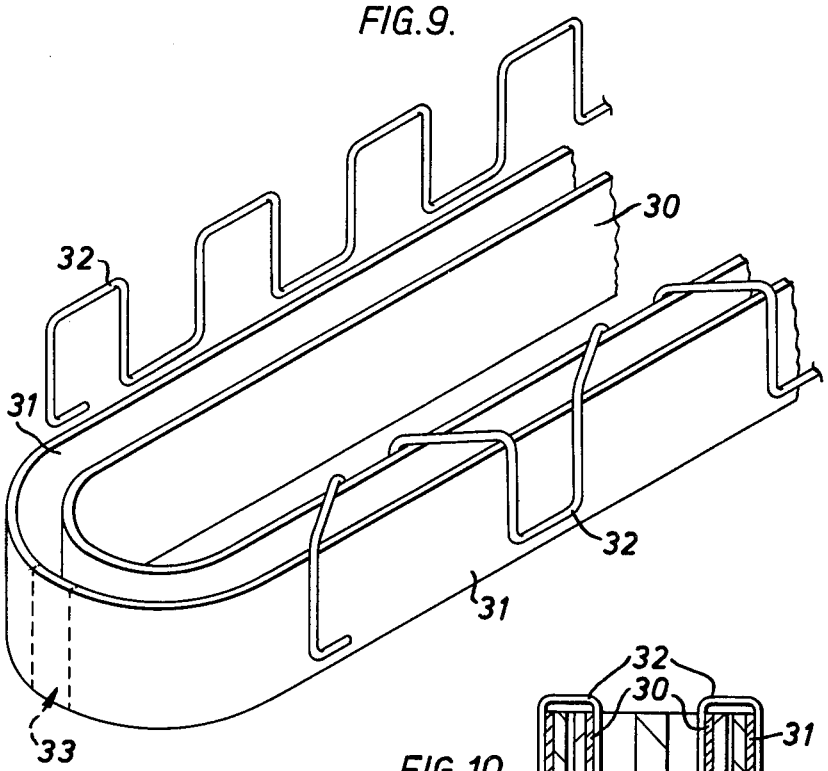
Figure 10:
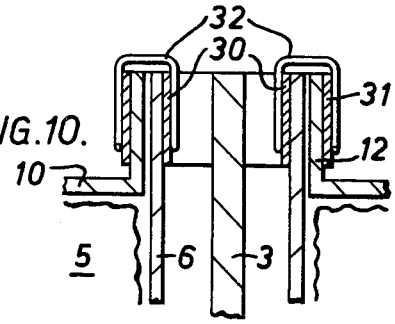

The clamp arrangement shown in FIGS. 9 and 10 comprises an inner band (30), an outer band (31) and a clipping device (32) in the form of a springy wire bent in a sinuous path of essentially "U"-shaped profile. In FIG. 9, one device is shown assembled over the clamp bands and for clarity one is shown removed from the bands. The clipping device can be applied round the curve in the clamp but as shown in FIG. 9 it may if desired by confined to the straight portions of the clamp. By choosing bands of correct dimensions, the curved portions of the clamp can be automatically held in compression, though if desired the outer band may be crimped, for example at 33 to apply or increase the compression.

Figure 11:
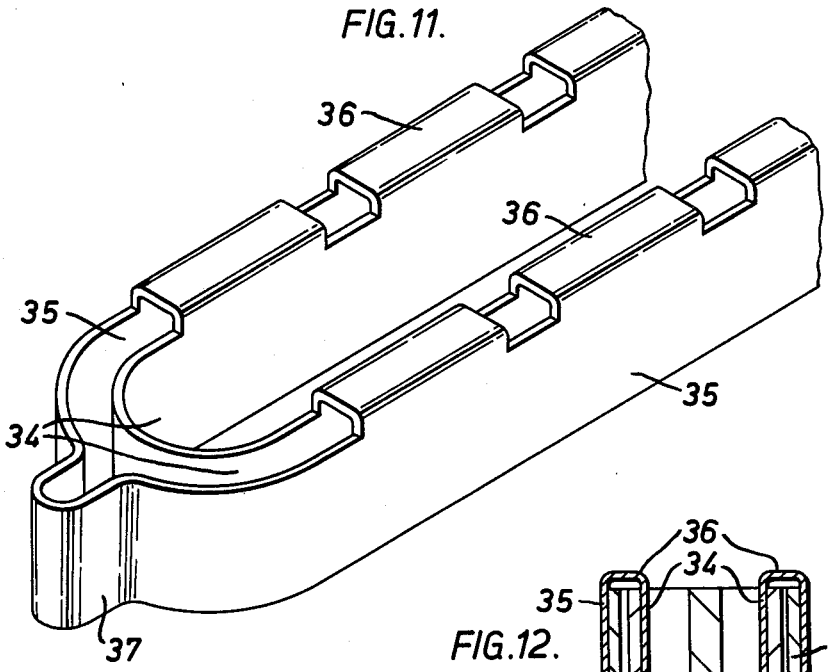
Figure 12:
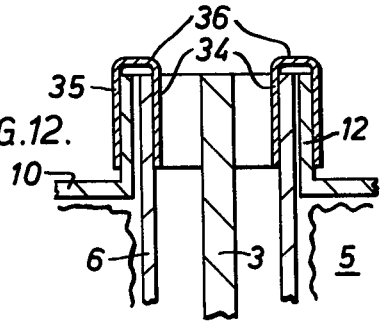

The clamp shown in FIGS. 11 and 12 is an embodiment wherein instead of separate inner and outer bands clipped together by separate clips, the bands are formed with integral bridging members. Thus an inner band (34) and an outer band (35) are formed with integral bridging portions (36). As shown in FIG. 12 the assembled diaphragm (6) and support sheet (10) are located between the inner and outer bands (34 and 35). The bridging portions (36) of the clamp are then crimped to urge the bands together and clamp the diaphragm (6) and support sheet (10) between them. Outer band (35) is provided at the curved portions with a crimpable section (37) for applying compression to the curved portions of the bands.

Figure 13:
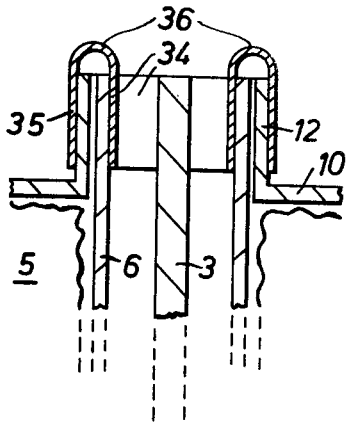
Figure 14:
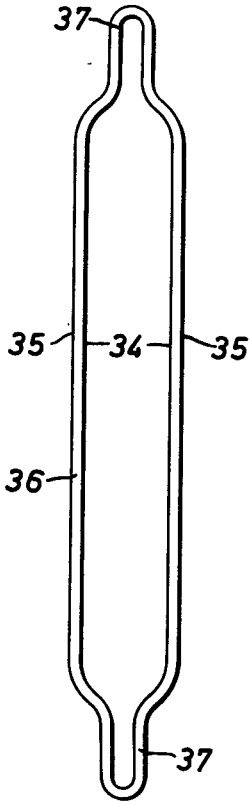

It will be appreciated that instead of the bands (34 and 35) being bridged at intervals by integral bridging members as shown in FIG. 11, they may be bridged by a continuous bridge piece such that the clamp is of channel-shaped of 'U' or hemi-cylindrical cross-section. Such a clamp, of 'U'-section, is shown in FIGS. 13 and 14.

It will readily be appreciated that as is described in respect of the clamp arrangement shown in FIG. 5, the clamping arrangements shown in FIGS. 8, 10, 12 and 14 may include a strip of adhesive or elastomic material between the diaphragm (6) and the support sheet (10) and/or a similar insert between the clamp band(s) and the support sheet (10) and diaphragm or membrane (6).

What is claimed is:

1. An electrolytic cell comprising: a plurality of anodes; a cathode box providing a plurality of cathodes so positioned that an anode is located between each pair of adjacent cathodes; a diaphragm or membrane located between adjacent anodes and cathodes; first and second diaphragm- or membrane-supports having lips defining slots therein and made of a material which is resistant to the conditions prevailing in the cell, the supports being located such that the slots in the first support are in alignment with the slots in the second support; the edges of the diaphragms or membranes being sealed to the lips defining the slots in the supports whereby the arrangement of diaphragms or membranes and the slots in the supports define spaces into which the anodes extend; and each diaphragm or membrane being sealed to the lips defining a slot in the support by means of one or more clamps which form an essentially leak-tight seal between the diaphragm or membrane and the lips of the support over substantially the entire extent thereof, each clamp comprising co-operating inner and outer clamp members of which at least the inner clamp member comprises a flexible strip or band for spreading the force exerted by the one or more clamps to provide effective sealing.

2. An electrolytic cell as claimed in claim 1 wherein the outer clamp member also comprises a flexible strip or band.

3. An electrolytic cell as claimed in claim 1 or claim 3 wherein the clamp comprises one or more crimpable portions for urging the inner and outer clamp members together and causing them to cooperate to seal the diaphragm or membrane to the lips of the support.

4. An electrolytic cell as claimed in claim 1, 3 or 4 wherein the clamp comprises one or more clips for clipping and urging together the inner and outer clamp members and causing them to co-operate to seal the diaphragm or membrane to the lips of the support.

5. An electrolytic cell as recited in claim 4 wherein portions of the channel-shaped member connecting of the U-section or the hemi-cylindrical section are omitted such that the clamp comprises inner and outer strips or bands bridged at intervals along their lengths by integral bridging pieces.

6. An electrolytic cell as claimed in claim 3 wherein the clamp comprises a channel-shaped member of essentially 'U'-section or hemi-cylindrical section.

7. An electrolytic cell as claimed in claim 1 wherein the clamp is made of a film-forming metal.

8. An electrolytic cell as claimed in claim 1 wherein the clamp comprises a clipping device in the form of a wire bent into a sinuous form to yield shaped profiles and assembled over the inner and outer clamp members such that alternate profiles or groups of profiles lie on opposite sides of the clamps members, the sinuous form of the clipping device providing essentially square or rectangular profiles.

9. An electrolytic cell comprising: a plurality of anodes; a cathode box providing a plurality of cathodes so positioned that an anode is located between each pair of adjacent cathodes; a diaphragm or membrane located between adjacent anodes and cathodes; first and second diaphragm-or membrane-supports having lips defining slots therein and made of a material which is resistant to the conditions prevailing in the cell, the supports being located such that the slots in the first support are in alignment with the slots in the second support; the edges of the diaphragms or membranes being sealed to the lips defining the slots in the supports whereby the arrangement of diaphragms or membranes and the slots in the supports define spaces into which the anodes extend; and each diaphragm or membrane being sealed to the lips defining a slot in the support by means of one or more clamps which form an essentially leak-tight seal between the diaphragm or membrane and the lips of the support, each clamp comprising co-operating inner and outer clamp members of which at least the inner clamp member comprises a flexible strip or band, and a clipping device in the form of a wire bent into a sinuous form to yield shaped profiles and assembled over the inner and outer clamp members such that alternate profiles or groups of profiles lie on opposite sides of the clamp members, the sinuous form of the clipping device providing essentially square or rectangular profiles.

10. An electrolytic cell comprising: a plurality of anodes; a cathode box providing a plurality of cathodes so positioned that an anode is located between each pair of adjacent cathodes; a diaphragm or membrane located between adjacent anodes and cathodes; first and second diaphragm-or membrane-supports having lips defining slots therein and made of a material which is resistant to the conditions prevailing in the cell, the supports being located such that the slots in the first support are in alignment with the slots in the second support; the edges of the diaphragms or membranes being sealed to the lips defining the slots in the supports whereby the arrangement of diaphragms or membranes and the slots in the supports define spaces into which the anodes extend; and each diaphragm or membrane being sealed to the lips defining a slot in the support by means of one or more clamps which form an essentially leak-tight seal between the diaphragm or membrane and the lips of the support, each clamp comprising co-operating inner and outer clamp members of which at least the inner clamp member comprises a flexible strip or band, and one or more clips for clipping and urging together the inner and outer clamp members and causing them to co-operate to seal the diaphragm or membrane to the lips of the support.

11. An electrolytic cell as claimed in claim 10 wherein the clamp comprises a series of clips located at intervals along the length of the inner and outer clamp members, each clip having an essentially 'U'-shaped or hemi-cylindrical cross-section.

12. An electrolytic cell as claimed in claim 10 wherein the clamp comprises a clipping device in the form of a wire bent into a sinuous form to yield shaped profiles and assembled over the inner and outer clamp members such that alternate profiles or groups of profiles lie on opposite sides of the clamp members.

13. An electrolytic cell as claimed in claim 10 wherein the clips are crimpable to urge together the inner and outer clamp members.

14. An electrolytic cell as claimed in claim 10, wherein the clip comprises spring wire.

15. An electrolytic cell comprising: a plurality of anodes; a cathode box providing a plurality of cathodes so positioned that an anode is located between each pair of adjacent cathodes; a diaphragm or membrane located between adjacent anodes and cathodes; first and second diaphragm-or membrane-supports having lips defining slots therein and made of a material which is resistant to the conditions prevailing in the cell, the supports being located such that the slots in the first support are in alignment with the slots in the second support; the edges of the diaphragms or membranes being sealed to the lips defining the slots in the supports whereby the arrangement of diaphragms or membranes and the slots in the supports define spaces into which the anodes extend; and each diaphragm or membrane being sealed to the lips defining a slot in the support by means of one or more clamps which form an essentially leak-tight seal between the diaphragm or membrane and the lips of the support, each clamp made of a film-forming metal and comprising co-operating inner and outer clamp members of which at least the inner clamp member comprises a flexible strip or band.

16. An electrolytic cell as claimed in claim 15 wherein the clamp is made of titanium or platinised titanium.

* * * * *